US012774639B2

(12) United States Patent
Wolters et al.

(10) Patent No.: US 12,774,639 B2
(45) Date of Patent: Oct. 27, 2026

(54) METHOD OF COMPLETING WELL WITH TWO-STAGE IN-WELL WET-MATE CONNECTION

(71) Applicant: Weatherford Technology Holdings, LLC, Houston, TX (US)

(72) Inventors: Sebastiaan J. Wolters, Kingwood, TX (US); John J Grunbeck, Northford, CT (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 19/183,274

(22) Filed: Apr. 18, 2025

(65) Prior Publication Data

US 2025/0243716 A1 Jul. 31, 2025

Related U.S. Application Data

(62) Division of application No. 18/582,515, filed on Feb. 20, 2024, now Pat. No. 12,338,687.

(60) Provisional application No. 63/613,666, filed on Dec. 21, 2023.

(51) Int. Cl.
*E21B 17/02* (2006.01)
*E21B 47/12* (2012.01)

(52) U.S. Cl.
CPC ..... *E21B 17/023* (2013.01); *E21B 47/12* (2013.01)

(58) Field of Classification Search
CPC ..... E21B 17/023; E21B 47/12; E21B 17/028
See application file for complete search history.

(56) References Cited

U.S. PATENT DOCUMENTS

| | | | | |
|---|---|---|---|---|
| 6,510,899 | B1 | 1/2003 | Sheiretov et al. | |
| 6,776,636 | B1 | 8/2004 | Cameron et al. | |
| 7,640,977 | B2 * | 1/2010 | Jonas | E21B 17/08 166/242.6 |
| 7,900,698 | B2 | 3/2011 | Stoesz | |

(Continued)

FOREIGN PATENT DOCUMENTS

| | | | |
|---|---|---|---|
| NO | 324348 | | 9/2007 |
| WO | 2009023609 | A2 | 2/2009 |
| WO | 2017213726 | A2 | 12/2017 |

OTHER PUBLICATIONS

Halliburton, "Fuzion(R)-EH Electro-Hydraulic Downhole Wet-Mate Connector," Brochure H013793, copyright 2021, dated Mar. 2021.

(Continued)

*Primary Examiner* — James G Sayre
(74) *Attorney, Agent, or Firm* — Cabello Hall Zinda, PLLC

(57) ABSTRACT

A wet-mate connection is used in a well and comprises first and second connection assemblies and an actuator. The first connection assembly includes at least one first connector for at least one first control line. The second connection assembly is configured to connect with the first connection assembly and includes at least one second connector for at least one second control line. The second connector is movable on the second connection assembly between a retracted condition and an extended condition. In the extended condition, the second connector can mate with the first connector to communicate the first and second control lines with one another. The actuator is disposed on the second connection assembly and is configured to move the second connector at least from the retracted condition to the extended condition.

21 Claims, 10 Drawing Sheets

(56) References Cited

U.S. PATENT DOCUMENTS

| | | | | |
|---|---|---|---|---|
| 8,752,635 | B2 | 6/2014 | Wang et al. | |
| 8,839,850 | B2 | 9/2014 | Algeroy et al. | |
| 8,851,189 | B2 | 10/2014 | Tips et al. | |
| 9,062,530 | B2 * | 6/2015 | Patel | E21B 43/04 |
| 9,404,314 | B2 | 8/2016 | Perez et al. | |
| 10,718,181 | B2 | 7/2020 | Saldanha et al. | |
| 11,498,733 | B2 | 11/2022 | Wang | |
| 12,104,441 | B2 * | 10/2024 | Keane | E21B 47/135 |
| 12,503,921 | B2 * | 12/2025 | Steele | E21B 17/028 |
| 2005/0072564 | A1 | 4/2005 | Grigsby et al. | |
| 2005/0074210 | A1 | 4/2005 | Grigsby et al. | |
| 2005/0194150 | A1 | 9/2005 | Ringgenberg | |
| 2008/0029274 | A1 | 2/2008 | Rytlewski et al. | |
| 2011/0192596 | A1 | 8/2011 | Patel | |
| 2013/0048307 | A1 * | 2/2013 | Patel | E21B 17/0283 166/85.1 |
| 2015/0368983 | A1 | 12/2015 | Perez et al. | |
| 2016/0356095 | A1 | 12/2016 | Perez et al. | |
| 2022/0170346 | A1 | 6/2022 | Steele et al. | |
| 2024/0337185 | A1 * | 10/2024 | McLauchlan | E21B 17/028 |

OTHER PUBLICATIONS

Halliburton, "Fuzion(R)-H Hydraulic Downhole Wet-Mate Connector," Brochure H013777, copyright 2021, dated Oct. 2021.

International Search Report and Written Opinion in PCT Appl. PCT/US24/52679 mailed Jan. 3, 2025, 8-pgs.

Schlumberger, "HEWM Hydraulic and Electric Downhole Wet-Mate Connector," Brochure , copyright 2019.

* cited by examiner

METHOD OF COMPLETING WELL WITH TWO-STAGE IN-WELL WET-MATE CONNECTION

CROSS-REFERENCE TO RELATED APPLICATIONS

This application is a divisional of U.S. application Ser. No. 18/582,515 filed Feb. 20, 2024—now U.S. Pat. No. 12,338,687, which claims the benefit of U.S. Provisional Appl. No. 63/613,666 filed Dec. 21, 2023, which are both incorporated herein by reference in their entireties.

BACKGROUND OF THE DISCLOSURE

A completion system having electronic components has been traditionally run in a borehole using a single trip. For example, the completion system may have packers and may have electronic components, such as electronic Interval Control Valves (eICVs). A cable is strapped to tubing of the completion system using collars, clamps, flatpacks, and the like. The cable connects from surface to the electronic components and provides power and controls for their operation.

If the Blow Out Preventer (BOP) needs to be closed during run-in of the completion system, the BOP is less effective in closing around the tubing when it has the collars, clamps, flatpacks, and the like. This poses a potential hazard during run in because the hydrostatic fluid column in the borehole may be the only effective well barrier available should the BOP not effectively close around the tubing.

During run-in, the BOP is much more effective in closing around a drill pipe that does not have any collars, clamps, flatpacks, and the like. For this reason, installation of a completion system having electronic components has instead been performed in two stages. Initially, a lower portion of the completion system is installed on a drill pipe and is run downhole. Downhole, the packers on the lower portion of the completion system are then set.

A second trip then installs an upper portion of the completion system in the borehole. A wet-mate connection is used between the upper and lower portions of the completion system so the cable from the surface can connect to the electronic components and can provide the power and control for their operation. The upper portion of the completion system will also have collars, clamps, flatpacks, and like for the cable. Yet, even though the BOP may be less effective in closing during the second trip, the packers on the lower portion of the completion system set in the borehole can act as a secondary barrier.

Although making two trips and using a wet-mate connection can be beneficial when installing a completion system in a borehole, there are still drawbacks and challenges to such an approach. For example, the running procedure can involve high forces and vibrations when the upper portion and tubing hanger of the completion system are landed. These forces and vibrations can damage the delicate electric and fiber optic connectors inside the wet-mate connection. Historically, operators have simply accepted the risks associated with making up the wet-mate connection.

Additionally, any need to reconnect or refresh the mating of the connectors in the wet-mate connection requires operators to pull and reset the upper portion of the completion system. If a first attempt to connect the wet-mate has failed, for example, then the upper completion is pulled a few feet and further attempts are made until proper electrical or fiber optic continuity is achieved. However, continuity is not always achieved, resulting in a loss of connection to electric or fiber optic components below the wet-mate connection.

Even when connected, the connectors in the wet-mate connection may need to be refreshed or re-established at some point during use. The upper portion of the completion system is pulled and reset to refresh the mating between the connectors. As expected, the need to pull and reset the upper completion portion is undesirable for many reasons. As an alternative, vibration can be induced in the wet-mate connection to keep the electrical contact fresh. However, such vibration is not desired for fiber optic connectors, and this is therefore not acceptable as well.

The subject matter of the present disclosure is directed to overcoming, or at least reducing the effects of, one or more of the problems set forth above.

SUMMARY OF THE DISCLOSURE

Some implementations disclosed herein relate to an apparatus or system, such as a wet-mate connection, for use in a well. For example, the wet-mate connection can comprise a first connection assembly, a second connection assembly, and an actuator. The first connection assembly can include at least one first connector for at least one first control line. The second connection assembly can be configured to connect with the first connection assembly and can include at least one second connector for at least one second control line. The at least one second connector can be movable on the second connection assembly at least from a retracted condition to an extended condition. For instance, the at least one second connector in the extended condition can be configured to mate with the at least one first connector and can be configured to communicate the at least one second control line with the at least one first control line. The actuator can be disposed on the second connection assembly and can be configured to move the at least one second connector at least from the retracted condition to the extended condition.

The described implementations may also include one or more of the following features. In the wet-mate connection, the actuator can be further configured to move the at least one second connector from the extended condition to the retracted condition.

The wet-mate connection may include an electronic controller being connectable to the actuator. The electronic controller can be wirelessly controllable to actuate the actuator. The actuator may include an electric motor being electrically connected to the electronic controller. The electronic controller can have an electric power source and can be wirelessly controllable to power the electric motor. Alternatively, the actuator may include a hydraulic piston being hydraulically connected to the electronic controller. The electronic controller can have an electric power source and a hydraulic pump. The electronic controller can be wirelessly controllable to power the hydraulic pump with the electric power source and can communicate hydraulics from a hydraulic source to the hydraulic piston of the actuator.

In the wet-mate connection, the first connection assembly can be configured to couple to a completion string used in the well and can define a first flow passage communicating with the completion string. The second connection assembly can be configured to couple to a production string used in the well and defines a second flow passage communicating with the production string, the second connection assembly connected with the first connection assembly being configured to communicate the second flow passage with the first flow passage.

The first connection assembly can be connected to the at least one first control line on the completion string; and where the second connection assembly is connected to the at least one second control line on the production string. Moreover, the first flow passage can define a polished bore receptacle; and where the second connection assembly may include a stinger for the second flow passage, the stinger being configured to seal inside the polished bore receptacle.

In the wet-mate connection, the second connection assembly can be configured to couple to a running string used in the well and can define a second flow passage communicating with the running string. The second connection assembly connected with the first connection assembly can be configured to communicate the second flow passage with the first flow passage. The wet-mate connection may include an electronic controller disposed on the running string and being connectable to the actuator. The electronic controller can be wirelessly controllable to actuate the actuator.

In the wet-mate connection, the actuator may include a trigger mechanism biasing the at least one second connector to the extended condition when the trigger mechanism is released.

In one implementation, a system can comprise a wet-mate connection as disclosed above. The system can further include: a lower completion having the first connection assembly; and an upper completion having the second connection assembly and the actuator.

In another implementation, a system can comprise a wet-mate connection as disclosed above. The system can include: a lower completion having the first connection assembly; and a running string having the second connection assembly, the actuator, and an electronic controller, the electronic controller connected to the actuator and being wirelessly controllable to actuate the actuator.

Some implementations disclosed herein relate to a method of completing a well. For example, the method may include installing a lower completion in a well using a running string, the lower completion having one or more lower control lines and having a lower connection assembly, the lower connection assembly having one or more lower connectors connected to the one or more lower control lines. The method may also include removing the running string from the well by disconnecting a running connection assembly on the running string from the lower connection assembly. The method may furthermore include connecting an upper completion in the well to the lower completion by: installing an upper connection assembly on the upper completion, the upper completion having one or more upper control lines, the upper connection assembly having one or more upper connectors connected to one or more the upper control lines; running the upper completion in the well; connecting the upper connection assembly on the upper completion to the lower connection assembly on the lower completion; and actuating the one or more upper connectors to mate with the one or more lower connectors. Other aspects of this implementation include one or more corresponding systems, apparatus, and devices, each configured to perform the actions of the disclosed methods.

The described implementations may also include one or more of the following features. In the method, installing the lower completion in the well using the running string may include: connecting the running connection assembly to the lower connection assembly, the running connection assembly having an electronic controller connected to one or more running connectors, the one or more running connectors connected to the one or more lower connectors; running the lower completion in the well using the running string; remotely operating the lower completion in the well using the electronic controller; and setting the lower completion in the well.

In the method, removing the running string from the well by disconnecting the running connection assembly on the running string from the lower connection assembly may include remotely actuating the one or more running connectors with the electronic controller to unmate from the one or more lower connectors. For example, remotely actuating the one or more running connectors with the electronic controller to unmate from the one or more lower connectors may include: wirelessly telemetering a signal to the electronic controller; and actuating, with the electronic controller, at least one actuator on the running connection assembly to move the one or more running connectors from a mated condition to an unmated condition with the one or more lower connectors.

In the method, disconnecting the running connection assembly on the running string from the lower connection assembly may include disengaging a connection mechanism on the running connection assembly from a profile on the lower connection assembly.

In the method, actuating the one or more upper connectors to mate with the one or more lower connectors may include: telemetering a signal to at least one actuator on the upper connection assembly; and actuating the at least one actuator to move the one or more upper connectors from an unmated condition to a mated condition with the one or more lower connectors. For example, telemetering the signal to the at least one actuator may include sending the signal via one of the one or more upper control lines.

In the method, connecting the upper connection assembly on the upper completion to the lower connection assembly on the lower completion may include: axially engaging the upper connection assembly on the lower connection assembly; radially engaging an upper alignment profile on the upper connection assembly to a lower alignment profile on the lower connection assembly; and aligning the one or more upper connectors with the one or more lower connectors using the upper and lower alignment profiles.

In the method, connecting the upper connection assembly on the upper completion to the lower connection assembly on the lower completion may include sealing a stinger on the upper connection assembly in a polished bore receptacle of the lower connection assembly. Implementations may further include one or more corresponding systems, apparatus, and devices, each configured to perform the actions of the disclosed techniques.

Some implementations disclosed herein relate to another method of completing a well. For example, the method may include connecting a running connection assembly of a running string to a lower completion, the lower completion having one or more lower control lines and having a lower connection assembly, the lower connection assembly having one or more lower connectors connected to the one or more lower control lines, the running connection assembly having an electronic controller connected to one or more running connectors, the one or more running connectors connected to the one or more lower connectors. The method may also include running the lower completion in the well using the running string. The method may furthermore include remotely operating the lower completion in the well using the electronic controller. The method may in addition include setting the lower completion in the well. The method may moreover include removing the running string from the well by: remotely actuating, with the electronic controller, at least one actuator on the running connection assembly to move the one or more running connectors from a mated condition to an unmated condition with the one or more lower connectors; and disconnecting the running connection assembly on the running string from the lower connection assembly. Other aspects of this implementation include one or more corresponding systems, apparatus, and devices, each configured to perform the actions of the disclosed methods.

The described implementations may also include one or more of the following features. The method may further include: installing an upper connection assembly on an upper completion, the upper completion having one or more upper control lines, the upper connection assembly having one or more upper connectors connected to the one or more the upper control lines; running the upper completion in the well; connecting the upper connection assembly on the upper completion to the lower connection assembly on the lower completion; and actuating the one or more upper connectors to mate with the one or more lower connectors. Implementations may further include one or more corresponding systems, apparatus, and devices, each configured to perform the actions of the disclosed techniques.

The foregoing summary is not intended to summarize each potential configuration or every aspect of the present disclosure.

DETAILED DESCRIPTION OF THE DISCLOSURE

Figure 1:
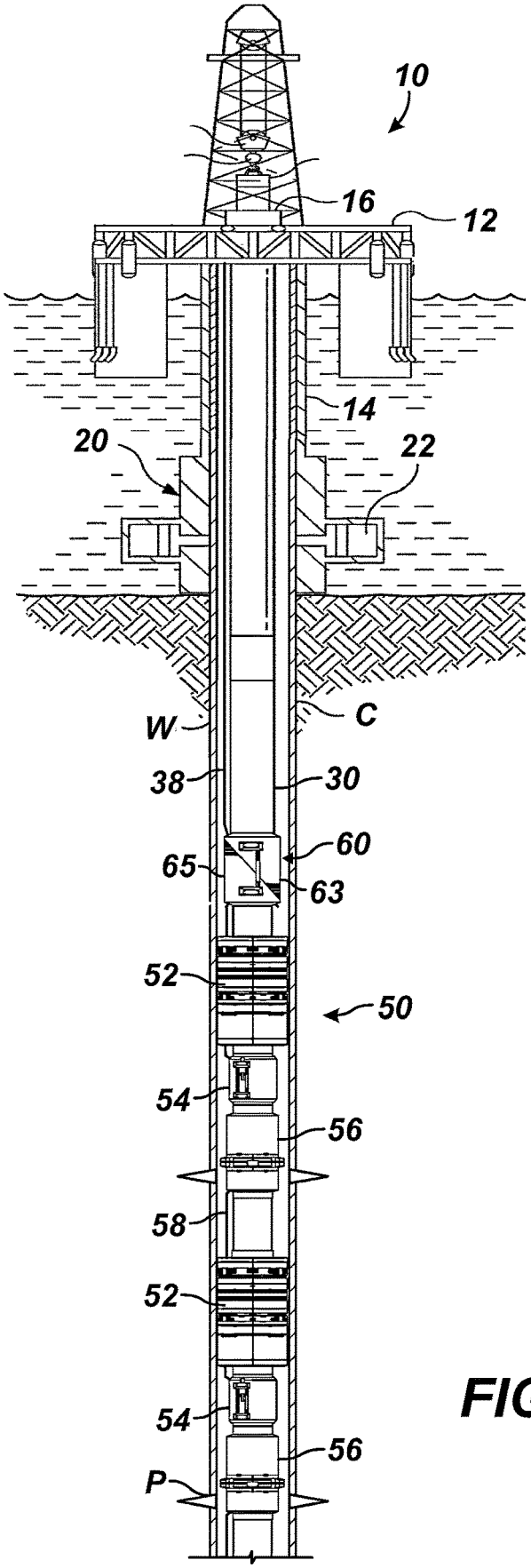
FIG. 1 illustrates an intelligent completion system of the present disclosure used in a subterranean well.

FIG. 1 illustrates an intelligent completion system 10 used in a subterranean wellbore W. As should be clearly understood, the completion system 10 represents merely one example of an application of the principles of this disclosure in practice, and a wide variety of other examples are possible. Therefore, the scope of this disclosure is not limited at all to the details of the completion system 10 and methods described herein and/or depicted in the drawings.

In the example of FIG. 1, a semi-submersible platform 12 may be positioned over a submerged oil and gas formation located below the sea floor. A subsea conduit 14 may extend from a deck of the platform 12 to a subsea wellhead installation 20 installed at the wellbore W. The wellhead installation 20 can include a blowout preventer 22.

The wellbore W can be a production well in which it is desired to produce fluids from an earth formation penetrated by the wellbore W. An upper section of the wellbore W can be lined with casing liner C, which can extend to an uncased section (not shown) of the wellbore W from which the fluids are produced. Alternatively, the casing liner C may include perforations P for communicating with the formation to produced fluids. Other combinations or numbers of casings, liners, or other tubulars may be used in the wellbore W, and fluids may be produced from cased or uncased sections of the wellbore W.

A lower completion string 50 is installed in the casing liner C and includes downhole components 52, 54, 56. An upper completion string 30 having one or more control lines 38 is installed downhole to the lower completion string 50 and is connected with a wet-mate connection 60 to the lower completion string 50. In this example, the lower completion string 50 includes packers 52, electronic sensors 54, and interval control valves 56.

The lower completion string 50 also includes one or more control lines 58, which can include one or more of an optical fiber line, an electric line, a hydraulic line, or the like. The control line 58 extends longitudinally along the lower completion string 50 and connects to one or more of the downhole components 52, 54, 56. The scope of this disclosure is not limited to any particular use of, or function performed by, the control line 58.

As an optical fiber, the control line 58 may be used for sensing temperature, pressure, vibration, acoustic signals, or any other downhole parameters. Alternatively, or in addition, the control line 58 as an optical fiber line may be used to transmit data, commands, light, or any other form of communication or transmission.

As an electric line, the control line 58 can provide electric power and signals to actuate and control opening and closing of the electronic interval control valves 56 (e.g., electric Interval Control Valve (eICV) devices). As an electric line, the control line 58 can conduct communications, sensor measurements, and other electronic signals to electronic elements of the downhole components. As a hydraulic line, the control line 58 can provide hydraulics to actuate and control any hydraulic elements of the downhole components, or to enable the injection of chemicals downhole.

In one configuration as disclosed herein, the lower completion string 50 is an electric assembly being actuated and controlled with electric power. Additionally, the electronic sensors 54 can measure downhole variables, such as temperature, pressure, flow, etc. The packers 52 may be conventional packers, which can be actuated and set using tubing pressure and conventional techniques. Other types of packers 52 can be used.

As shown in FIG. 1, the packers 52 are set in the casing liner C so that flow is prevented through an annulus formed in various zones radially between the lower completion string 50 and the casing liner C, and relative axial displacement between the packers 52 and the casing liner C is prevented. If the packers 52 are set in an uncased section of the wellbore W, then the packers 52 can seal between the lower completion string 50 and the wellbore W and can anchor the completion string 50 relative to the wellbore W.

Produced fluids flow from the formation, into the cased/uncased section of the wellbore W, into the completion assembly 10 via the opened interval control valves 56. Opening and closing of the interval control valves 56 can be controlled using electronic power and signals communicated downhole via the control lines 58. The produced fluid then travels up the completion system 10, where the upper completion string 30 is engaged with the lower completion string 50 for conducting the produced fluids to the surface (or near the surface, such as, a subsea production facility).

The wet-mate connection 60 connects the upper completion string 30 in sealed engagement with the lower completion string 50 and provides a continuous internal flow passage extending longitudinally through the engaged lower and upper completion strings 30, 50. As discussed below, the wet-mate connection 60 also provides optical, hydraulic, and/or electrical connections between the upper and lower completion strings 30, 50.

At surface, the upper completion string 30 extends from a wellhead 16, which has a tubing hanger and other components to support the tubing string of the upper completion string 30. The upper completion string 30 can include any suitable components, such as a production packer, a chemical injection mandrel, pressure gauges, a gas lift valve, an isolation packer, safety valve, or the like.

The upper completion string 30 also includes a control line 38, which extends longitudinally along the upper completion string 30 from the wellhead 16 to the wet-mate connection 60. The upper completion string 30 is installed in the well after the lower completion string 50, and the mechanical mating of the wet-mate connection 60 is completed downhole. After the upper completion string 30 is engaged with the lower completion string 30 and after the mechanical mating of the wet-mate connection 60 is completed, the connectors inside the wet-mate connection 60 are then mated together to connect the control lines 38, 58 in communication with one another. For this purpose, the wet-mate connection 60 on the lower and upper completion strings 30, 50 includes connection assemblies 63, 65 that house, protect, align, and operatively connect the internal connectors of the connection assemblies 63, 65, as described more fully below. These internal connectors can include optical, electrical, hydraulic connectors, and the like for the various lines to be connected between the upper and lower completion's control lines 38, 58.

Figure 2A:
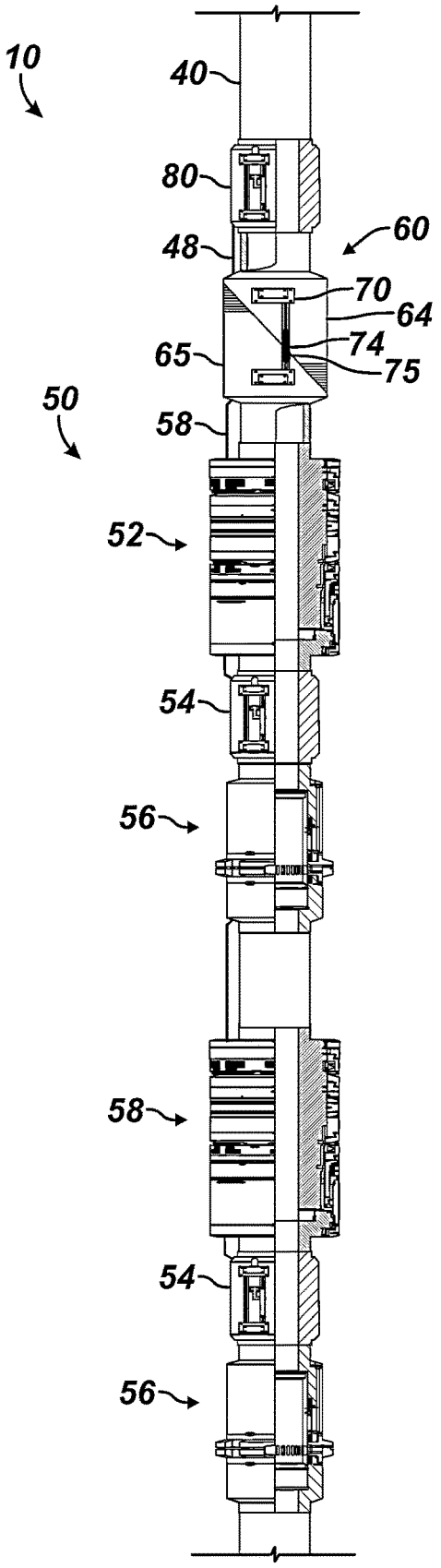
FIG. 2A illustrates a portion of the intelligent completion system arranged for deployment in a subterranean well.
Figure 2B:
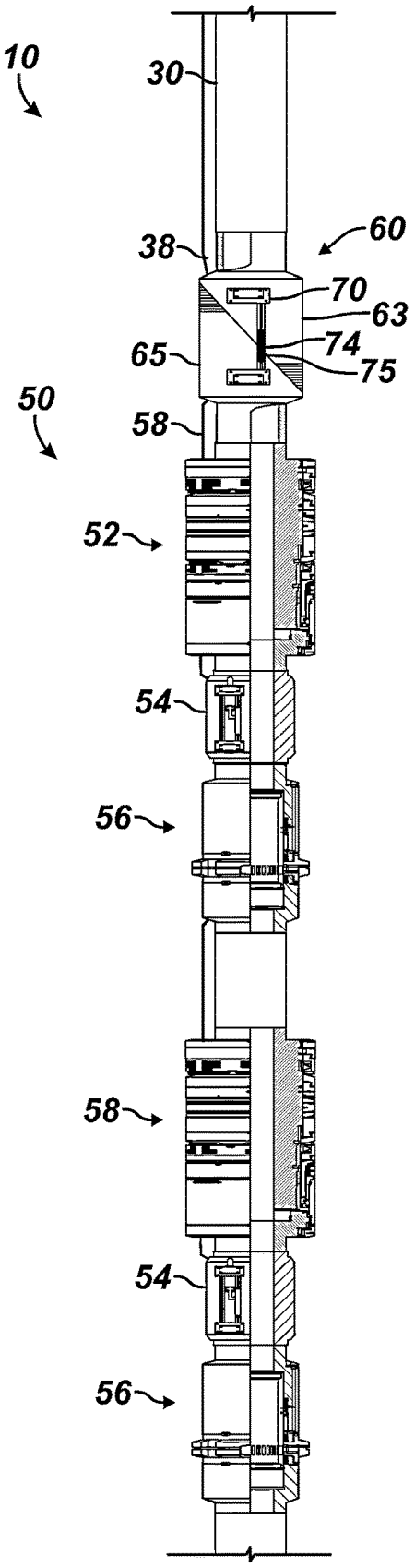
FIG. 2B illustrates a portion of the intelligent completion system arranged for operation in the subterranean well.

Looking in more detail, FIG. 2A illustrates a portion of the intelligent completion system 10 of the present disclosure arranged for deployment in a subterranean well. Meanwhile, FIG. 2B illustrates the portion of the intelligent completion system 10 of the present disclosure arranged for operation in the subterranean well.

The wet-mate connection 60 includes a first (lower) connection assembly 65 and a second (upper) connection assembly 63, 64. The lower connection assembly 65 is used for the lower completion string 50 and includes at least one first (lower) connector 75 for at least one first (lower) control line 58.

In FIG. 2A, the upper connection assembly 64 (or running connection assembly) is used for the running string 40 (i.e., drill pipe). Meanwhile, another upper connection assembly 63 in FIG. 2B is used for the upper completion string 30. The upper connection assembly 63, 64 is configured to connect with the lower connection assembly 65.

These connection assemblies 63, 64 can be different from another. Alternatively, the connection assemblies 63, 64 can be the same as one another and can actually be the same assembly used on both strings 30, 40 during the different running procedures discussed below.

The upper connection assembly 63, 64 has at least one connector 74 and at least one actuator 70. In general, if the assembly 63, 64 has more than one connector 74, one actuator 70 can be associated with more than one of the upper connectors 74, or each connector 74 can have its own associated actuator 70.

The at least one upper connector 74 is movable on the upper connection assembly 63, 64 between a retracted condition and an extended condition. The at least one upper connector 74 in the extended condition is configured to mate with the at least one lower connector 75 and is configured to communicate the respective control lines 38, 48 and 58 with one another. The at least one actuator 70 is disposed on the upper connection assembly 63, 64 and is configured to move the at least upper connector 74 at least from the retracted condition to the extended condition. However, the at least one actuator 70 can be configured to move the at least upper connector 74 from the extended condition to the retracted condition as well.

In FIG. 2A, an electronic controller 80 is connected to the at least one actuator 70 via a control line 48. The electronic controller 80 is wirelessly controllable to actuate the at least one actuator 70 to move the at least one upper connector 74. In one arrangement, the at least one actuator 70 can include an electric motor being electrically connected to the electronic controller 80, which can have an electric power source. The electronic controller 80 can be wirelessly controllable to power the electric motor of the at least one actuator 70 to move the at least one upper connector 74 to mate/unmate with the at least one lower connector 75.

In another arrangement, the at least one actuator 70 can include a hydraulic piston being hydraulically connected to a hydraulic power unit in the electronic controller 80. The electronic controller 80 can have an electric power source and an electric motor for the hydraulic power unit. When wirelessly controlled, the electronic controller 80 can power the electric motor with the electric power source. The electric motor can operate a hydraulic pump of the hydraulic power unit to communicate hydraulics from a hydraulic source to the hydraulic piston of the at least one actuator 70 to move the at least one upper connector 74 to mate/unmate with the at least one lower connector 75.

During operation, the lower completion string 50 of the intelligent completion system 10 in FIG. 2A is deployed in a first trip in the wellbore. The lower completion string 50 has a lower connection assembly 65 of the wet-mate connection 60 that connects to the at least one control line 58 for the lower completions' downhole components 52, 54, 56, etc. To deploy the lower completion string 50 in the wellbore during the first trip, a running tool on a running string or a drill pipe 40 has the wireless electronic controller 80 with an integral power source (battery pack). The wireless electronic controller 80 connects by at least one control line 48 to the upper connection assembly 64 of the wet-mate connection 60. The drill pipe 40, the wireless electronic controller 80, and the connection assemblies 64, 65 are used to run in, test, and set the lower completion string 50 of the intelligent completion system 10 in the wellbore.

When the lower completion string 50 is run in the well, the wireless electronic controller 80 can communicate with the electronic components of the lower completion string 50, such as electronic sensors 54, the interval control valves 56, etc. This can test the operation of the completion system 10. Setting procedures can be used to set the packers 52, which can be set by tubing pressure pumped down the drill pipe 40. Once the lower completion string 50 is set, the drill pipe 40, the wireless electronic controller 80, and upper connection assembly 64 are removed to leave the lower completion string 50 set in the well. The wireless electronic controller 80 and the at least one actuator 70 can be operated to unmate the connectors 74, 75 to avoid potential damage to the connectors 74, 75.

At this point, the upper completion string 30 as shown in FIG. 2B can be run downhole in a second trip to connect to the lower completion string 50 to complete the intelligent completion system 10. As shown in FIG. 2B, the upper completion string 30 has at least one control line 38 that connects to an upper connection assembly 63 of the wet-mate connection 60. This upper connection assembly 63 connects to the lower completion string 50 to complete the fluid communication between the completion strings 30, 50 and to make the control line connections as disclosed herein. The upper completion string 30 can include a production packer (not shown) and other components to be set in the wellbore.

When the upper and lower connection assemblies 63, 65 of the wet-mate connection 60 are engaged downhole, the at least one upper connector 74 is in a retracted condition so as to not connect or engage the at least one lower connector 75. A tubing hanger (not shown) of the upper completion string 30 is landed at a wellhead (e.g., 16). A tubing contraction joint (not shown) may be provided on the upper completion string 30 and can be designed to provide for controlled landing of the tubing hanger (not shown) after landing of the upper connection assembly 63 at a fixed point on top of the lower connection assembly 65. The tubing contraction joint (not shown) can allow the upper completion string 30 to contract longitudinally, in order to land the tubing hanger in the wellhead, for example. Once the upper completion string 30 is landed, the at least one actuator 70 on the upper connection assembly 63 can be actuated using a signal on the at least one control line 38 to move the at least one upper connector 74 from a retracted condition to an extended condition to mate with the at least one lower connector 75 to complete the control line connection.

In the disclosed procedures, the act of landing of the tubing hanger of the upper completion string 30 is separated from the act of mating the internal connectors 74, 75 inside the wet-mate connection 60. A landing stage connects the mechanical and sealing portions of the connection assemblies 63, 65 of the wet-mate connection 60 together while the upper completion string 30 and the tubing hanger (not shown) are landed in the wellhead. Then, in a connection stage, the internal connectors 74, 75 in the connection assemblies 63, 65 of the wet-mate connection 60 are mated together in a mated condition by using the at least one actuator 70. In this way, the at least one actuator 70 allows for much more delicate and precise mating to be performed in this mating stage of the internal connectors 74, 75 while any detrimental forces and vibrations from the landing stage have been eliminated from that process.

The two-stage mating process can also make disconnecting the internal connectors 74, 75 much more precise, thus preventing any damage to the members of these internal connectors 74, 75. In addition, the at least one actuator 70 can be used to exercise (unmate and remate) the internal connectors 74, 75. For example, the at least one upper internal connector 74 as an electronic connector in the wet-mate connection 60 can be "exercised" should the conductivity deteriorate over time due to self-passivation or due to other factors. Using the at least one actuator 70 to exercise the at least one internal connector 74 eliminates the need to pull the upper completion string 30 or to induce vibrations.

Figure 3:
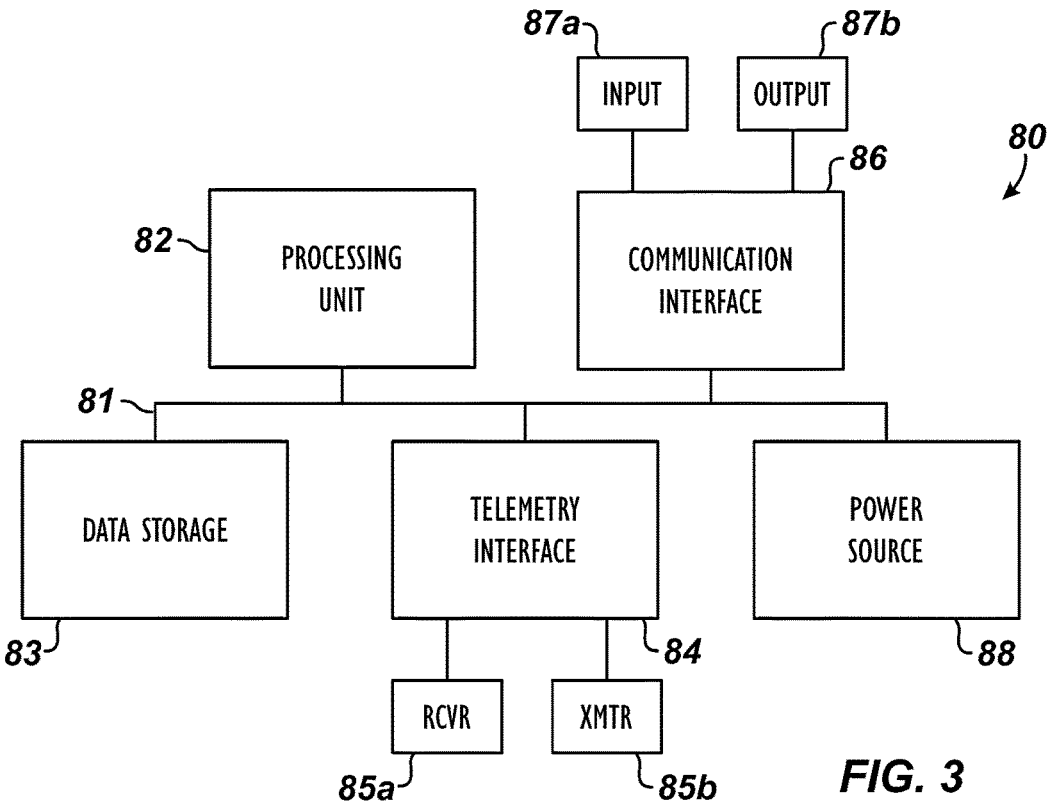
FIG. 3 illustrates a schematic view of a wireless electronic controller for the intelligent completion system.

FIG. 3 illustrates a schematic view of a wireless electronic controller 80 for the intelligent completion system. The wireless electronic controller 80 includes a bus 81, a processing unit 82, a memory or data storage component 83, a telemetry unit 84, an input/output communication interface 386, and a power source or battery module 88.

The bus 81 includes a component that permits communication among the components of the wireless electronic controller 80. The processing unit 82 is implemented in hardware, firmware, or a combination of hardware and software. The processing unit 82 can be a microprocessor, a microcontroller, a digital signal processor (DSP), a field-programmable gate array (FPGA), an application-specific integrated circuit (ASIC), or another type of processing component. In some examples, the processing unit 82 can include one or more processors capable of being programmed to perform a function.

The data storage component 83 may include one or more memories, such as a random-access memory (RAM), a read only memory (ROM), and/or another type of dynamic or static storage device (e.g., a flash memory, a magnetic memory, and/or an optical memory) that stores information and/or instructions for use by the processing unit 82.

The input/output communication interface 86 includes a component that permits the wireless electronic controller 80 to send and receive signals and controls and to provide power to components of the completion system. For example, the communication interface 86 may include an input component 87*a* that receives sensor measurements, operational feedback, and other input information from the components of the completion system. The communication interface 86 may also include an output component 87*b* that provides control signals, actuations, and other output information from the wireless electronic controller 80 to the components of completion system.

The telemetry unit 84 includes a transceiver-like component (e.g., a transceiver and/or a separate receiver 85*a* and transmitter 85*b*) that enables the wireless electronic controller 80 to communicate with other devices, such as via a wired connection, a wireless connection, or a combination of wired and wireless connections. The telemetry unit 84 may permit the wireless electronic controller 80 to receive information from another device, such as a control unit at surface, and/or provide information to another device. For example, the telemetry unit 84 may include an optical interface, an electrical interface, an acoustic interface, a radio frequency (RF) interface, or the like. In one arrangement, the receiver 85*a* of the telemetry unit 84 can include a radio frequency identification (RFID) reader.

The power source 88 is connected along the bus 81 to supply power to the processing unit 82 and other the internal components of the wireless electronic controller 80 as well as to supply power to other components of the completion system (10), such as the actuator (70). As a battery module, the power source 88 permits the wireless electronic controller 80 to be a portable integrated device for conducting the remote operations as disclosed herein.

The wireless electronic controller 80 may perform one or more processes described herein. The wireless electronic controller 80 may perform these processes by the processing unit 82 executing software instructions stored by a non-transitory computer-readable medium, such as the data storage component 83. A computer-readable medium is defined herein as a non-transitory memory device. A memory device includes memory space within a single physical storage device or memory space spread across multiple physical storage devices.

Instructions may be read into the data storage component 83 from another computer-readable medium or from another device via the telemetry unit 84. When executed, instructions stored in the data storage component 83 may instruct the processing unit 82 to perform one or more processes described herein. Additionally, or alternatively, hardwired circuitry may be used in place of or in combination with instructions to perform one or more processes described herein. Thus, implementations described herein are not limited to any specific combination of hardware circuitry and software.

The number and arrangement of components shown in FIG. 3 are provided as an example. In practice, the wireless electronic controller 80 may include additional components, fewer components, different components, or differently arranged components than those shown in FIG. 3. Additionally, or alternatively, a set of components (e.g., one or more components) of the wireless electronic controller 80 may perform one or more functions described as being performed by another set of components of the wireless electronic controller 80.

Figure 4A:
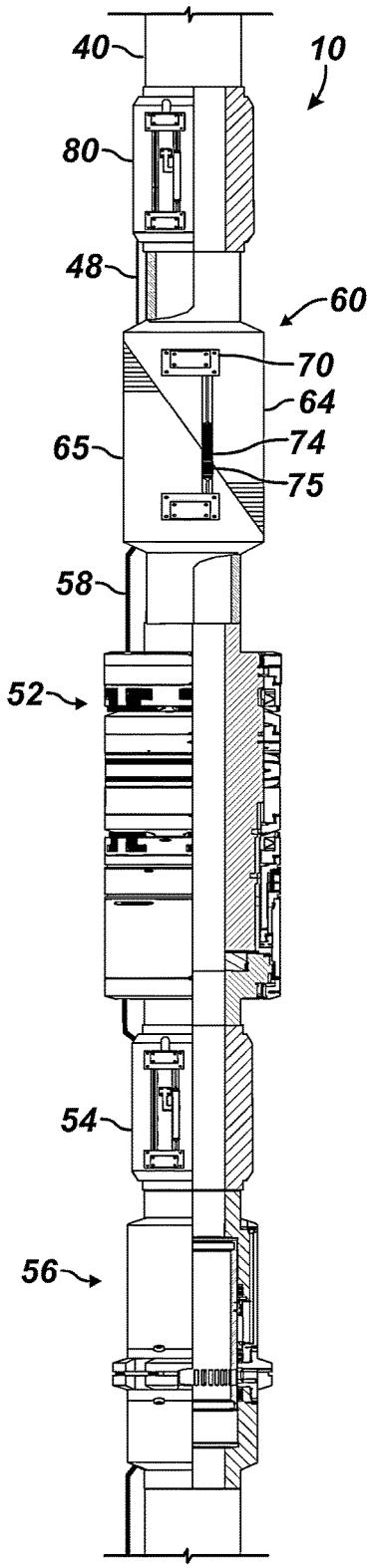
FIGS. 4A-4C illustrate portions of the intelligent completion system during stages of deployment downhole.
Figure 4B:
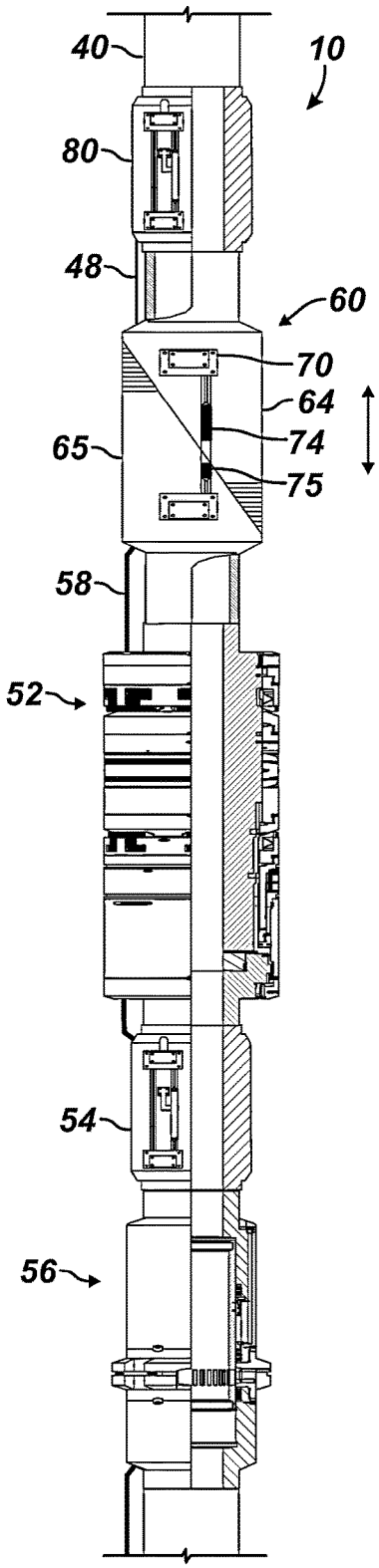
Figure 4C:
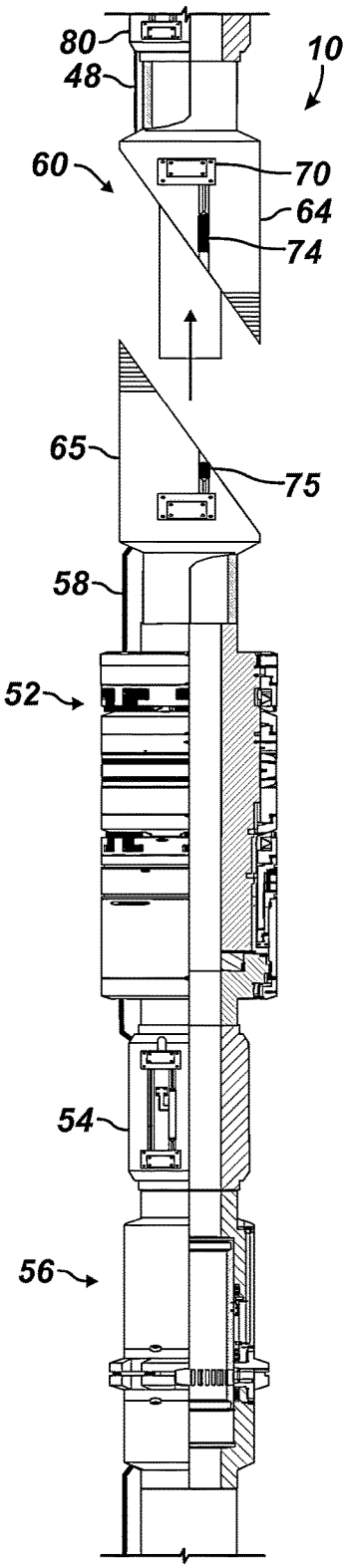
Figure 5A:
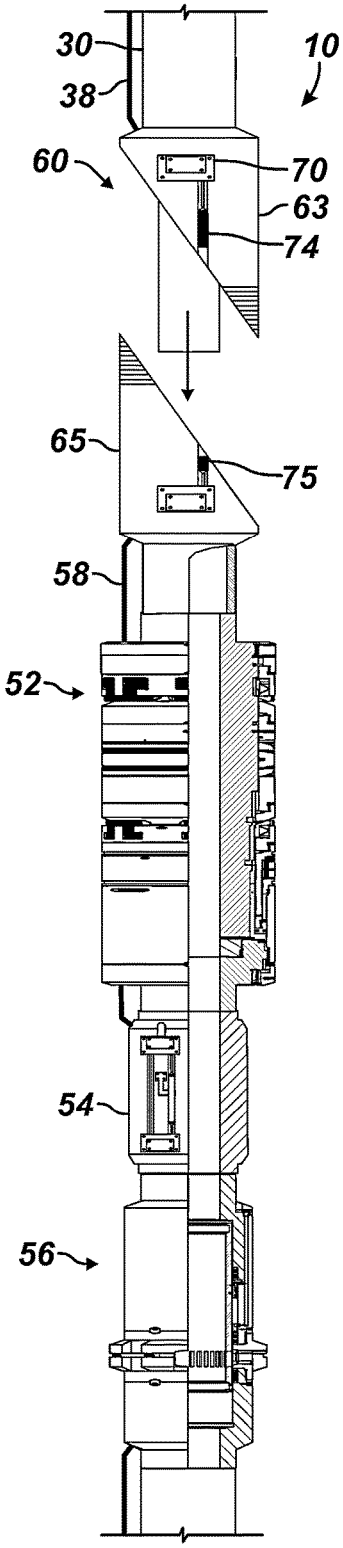
FIGS. 5A-5C illustrate portions of the intelligent completion system being set up for operation downhole.
Figure 5B:
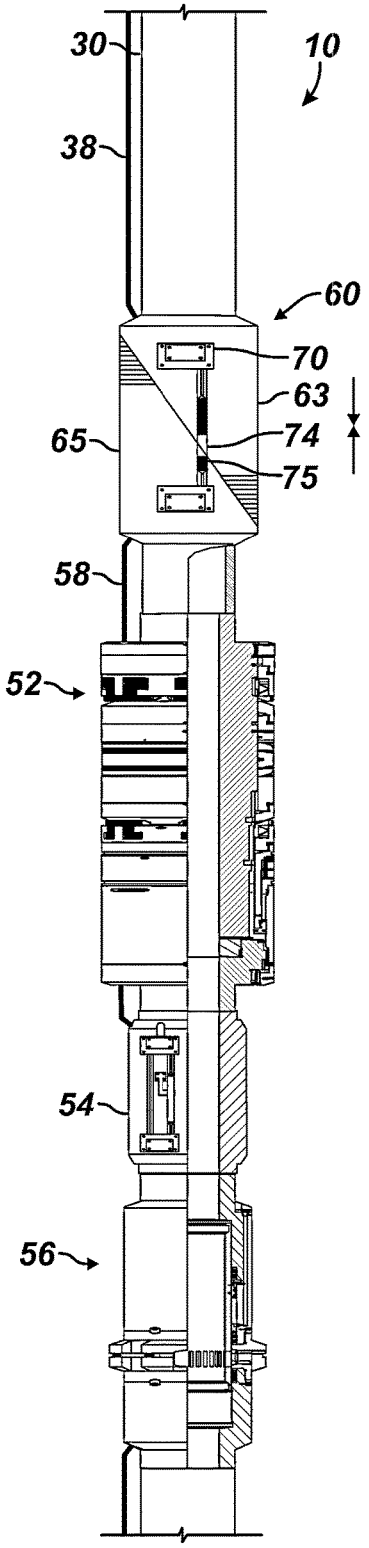
Figure 5C:
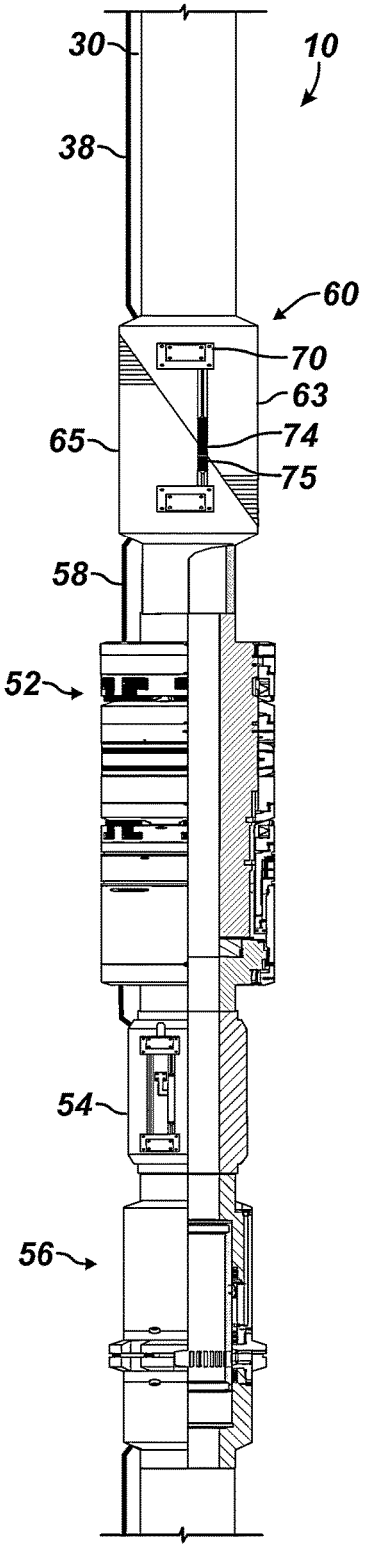

Further details of the deployment and landing procedures of the disclosed completion system 10 are discussed below with reference to FIGS. 4A-4C and 5A-5C. In particular, FIGS. 4A-4C illustrate portion of the intelligent completion system 10 during stages of deployment downhole. Meanwhile, FIGS. 5A-5C illustrate portion of the intelligent completion system 10 being set up for operation downhole.

As shown in FIG. 4A, the intelligent completion system 10 can be an all-electric Intelligent Completion System (eICS). The lower completion string 50 of the intelligent completion system 10 is run in hole (RIH) with a running tool disposed on drill pipe 40. Use of the drill pipe 40 has advantages over use of tubing when installing the intelligent completion system 10. If necessary during run-in, the BOP (not shown) can readily close and seal on the drill pipe 40. By contrast, closing and sealing the BOP on tubing having cables held by cross-coupling clamps and flatpack(s) would prove more difficult. In wells having high losses, a faster RIH speed is advantageous because the time taken to control the well is reduced.

Once the lower completion string 50 is at depth, the health of the system's components is checked before setting the production and isolation packers 52. If the internal connectors 74, 75 of the wet-mate connection 60 are not already connected during run-in, the actuator 70 can be operated to mate the internal connectors 74, 75. Communication can be made from the surface to the wireless electronic controller 80, and a signal can be conducted by the control line 48 to the actuator 70 of the upper connection assembly 64. The actuator 70 can then extend the upper connector 74 to mate with the lower connector 75. Additional communications can be made between the surface and the wireless electronic controller 80, and signals can be conducted by the control lines 48, 58 and connectors 74, 75 between the surface and the downhole components of the lower completion string 50.

The wireless electronic controller 80, which is disposed on the drill pipe 40 and which has an integral power sources (battery pack), can determine the state (open/closed) of the interval control valves 56, can check the opening/closing operation of the interval control valves 56, can test the measurements of any downhole sensors 54, and can perform other procedures.

The wireless electronic controller 80 can allow for one-way or two-way wireless communication. In one-way communication, for example, radio frequency identification (RFID) tags can be deployed down the drill pipe 40 and can be detected by the wireless electronic controller 80. In turn, the wireless electronic controller 80 can perform different checks and operations based on the instructions associated with the RFID tag.

Other forms of wireless telemetry can be used. For example, the wireless electronic controller 80 can use acoustic telemetry for two-way wireless communication between the surface and the lower completion string 50. Hydrophones or other acoustic transducers (not shown) of the wireless electronic controller 80 can detect acoustic signals (commands, controls, etc.) transmitted from surface, and the wireless electronic controller 80 can perform different checks and operations. In turn, the wireless electronic controller 80 can send acoustic signals (measurements, responses, etc.) back to the surface.

When activated, for example, the wireless electronic controller 80 can actuate the interval control valves 56 to verify that their operation meets performance criteria. The wireless electronic controller 80 can also verify the operation of any integral pressure/temperature sensors 54. Once positive confirmation has been received, the production and isolation packers 52 on the lower completion string 50 can be activated and set. Setting the packers 52 can be performed by increasing the tubing pressure of well fluids pumped downhole in the drill pipe 40 to the lower completion string 50 to hydraulicly set the packers 52. At this point, the lower completion string 50 functions as a well barrier.

The health-check of the lower completion string 50 prior to setting the packers 52 enables operators to retrieve and reinstall the lower completion string 50 to fix or replace any inoperable or damaged components. The health-check also makes the retrieval of the lower completion string 50 much easier and faster, especially when using Cut-To-Release Feed-Through packers.

As shown in FIG. 4B, the internal connectors 74, 75 in the wet-mate connection 60 are disconnected before releasing the wet-mate connection 60 by picking-up on the drill pipe 40. This is achieved using the actuator 70 of the wet-mate connection 60 to unmate the internal connectors 74, 75 of the wet-mate connection 60. Consequently, the mating and unmating of these delicate internal connectors 74, 75 in the wet-mate connection 60 is done under controlled circumstances. Accordingly, the internal connectors 74, 75 are not mated/are unmated/are in an unmated condition during any physical manipulation of the tubing or drill pipe from surface.

As then shown in FIG. 4C, once the internal connectors 74, 75 are safely unmated (de-coupled), the drill pipe 40 is picked-up to release the two connection assemblies 64, 65 of the wet-mate connection 60 itself. This action releases any anchoring mechanism (not shown) between the connection assemblies 64, 65 and pulls pressure retaining seals (not shown) of the wet-mate connection 60 from their respective seal bores. The running string (i.e., drill pipe 40), wireless electronic controller 80, and upper connection assembly 64 are now pulled out of hole (POOH).

At this point, the intelligent completion system 10 can be set up for downhole operation and use. As shown in FIG. 5A, the upper completion string 30 is RIH on tubing. The wireless electronic controller (80) previously used for deployment is no longer needed, although it could be deployed for redundancy. Instead, one or more control lines 38 (i.e., Tubing Encapsulated Conductors (TEC)) are clamped to the tubing and run with the upper completion string 30. Because the lower completion string 50 acts as a well barrier, the risk of having to close the BOP on the tubing of the upper completion string 30 is reduced.

As shown in FIG. 5B, the two connection assemblies 63, 65 of the wet-mate connection 60 are anchored and sealed while the tubing hanger (not shown) of the upper completion string 30 is landed at surface. At this stage, the internal connectors 74, 75 inside the wet-mate connection 60 are not yet mated so any forces to land the upper completion string 30 will not translate to the delicate internal connectors 74, 75.

As shown in FIG. 5C, once the upper completion string 30 is installed, the internal connectors 74, 75 in the wet-mate connection 60 are mated together in the mated condition using the actuator 70 on the upper connection assembly. Communication to the actuator 70 can be achieved from surface using the control lines 38 strapped to and run-in on the upper completion string 30. Once the internal connectors 74, 75 are mated, communication with the downhole components of the intelligent completion system 10 is established with surface. The completion is now ready for production/injection operations.

Having an understanding of the wet-mate connection and its operational procedures, discussion now turns to a particular example of a wet-mate connection according to the present disclosure.

Figure 6A:
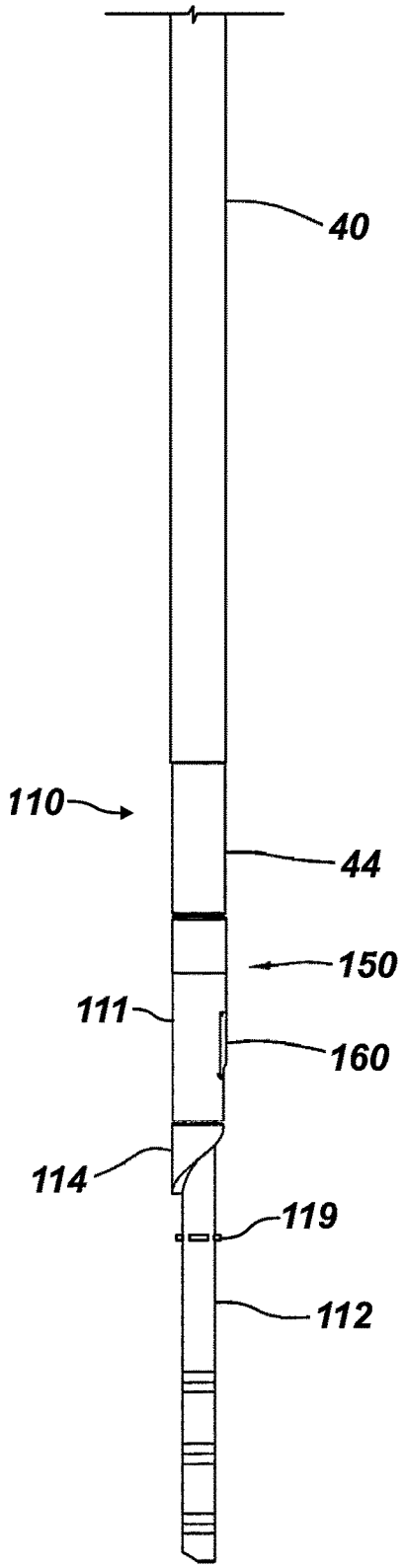
FIG. 6A illustrates an upper connection assembly according to the present disclosure disposed on a running string.
Figure 6B:
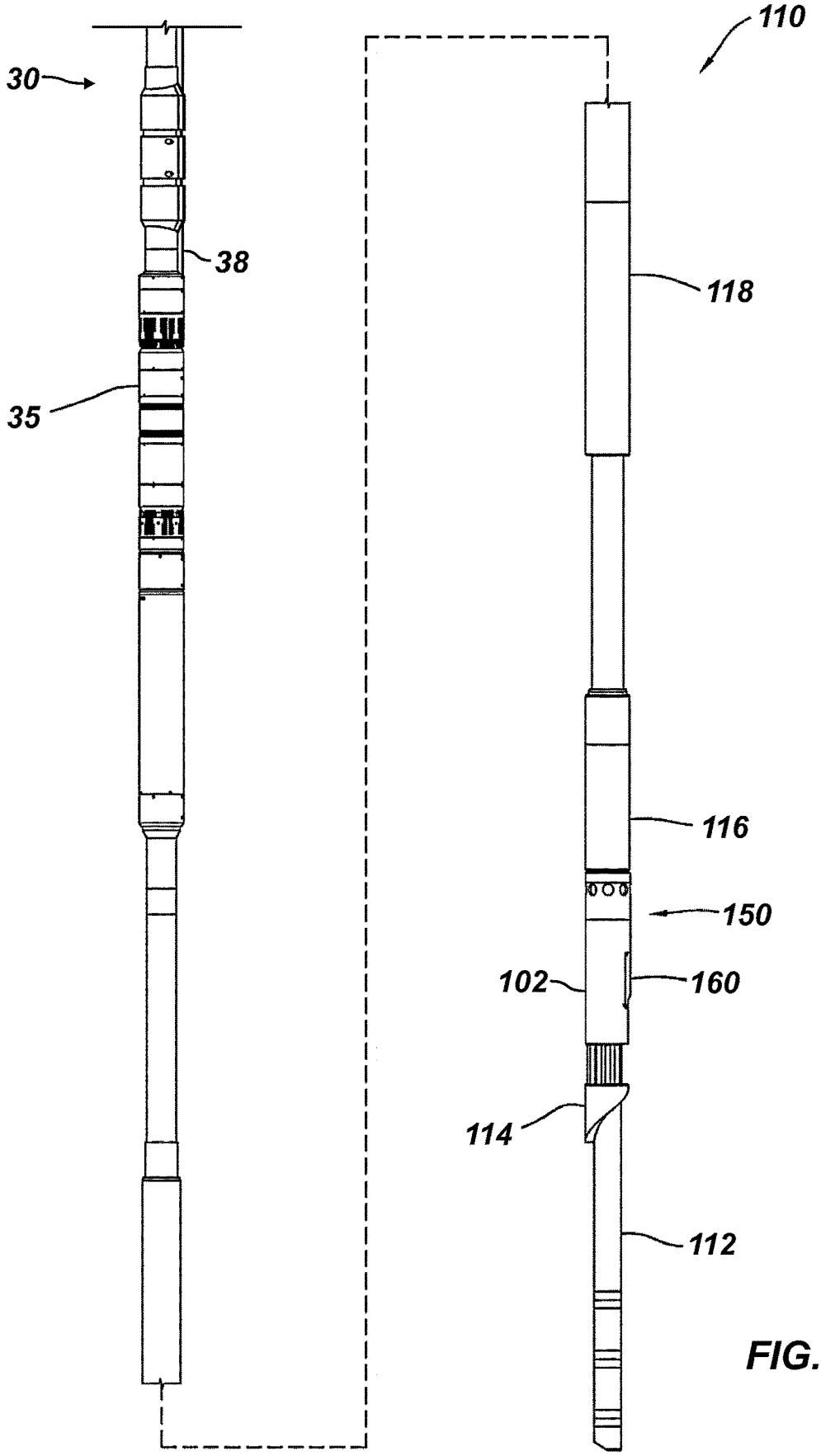
FIG. 6B illustrates the upper connection assembly according to the present disclosure disposed on an upper completion.

FIG. 6A illustrates an upper connection assembly 110 according to the present disclosure disposed on a running string or drill pipe 40, and FIG. 6B illustrates the upper connection assembly 110 according to the present disclosure disposed on an upper completion string 30.

In particular, FIGS. 6A-6B both illustrate a side view of a lower section of the upper connection assembly 110. In the example of FIG. 6A, the upper connection assembly 110 can be connected below other components of a running assembly connected to drill pipe 40. Meanwhile, the upper connection assembly 110 in FIG. 6B is shown connected below other components of an upper completion string 30. In both cases, the upper connection assembly 110 includes a connector housing 111, an inner seal mandrel or stinger 112, an actuator assembly 150, and one or more upper connectors 160.

Figure 7:
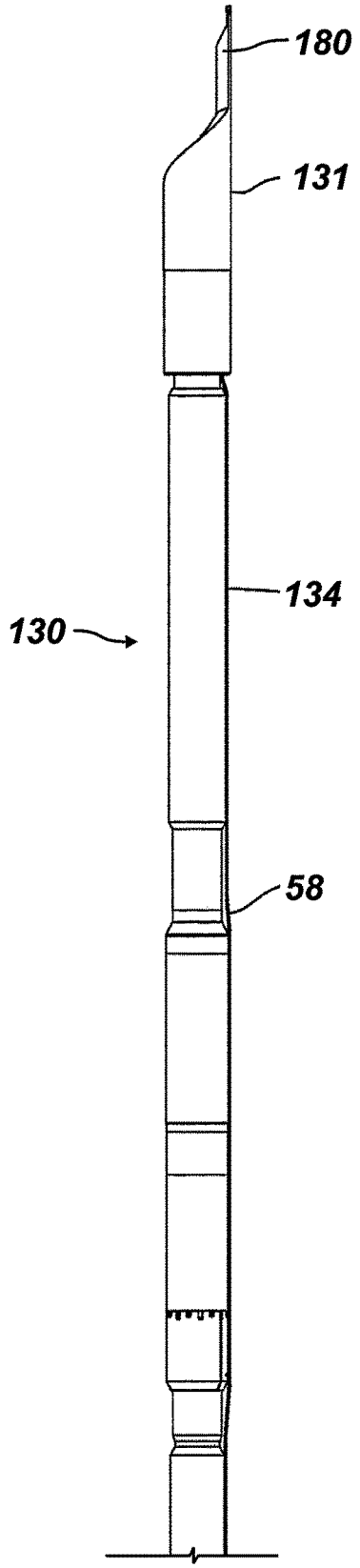
FIG. 7 illustrates a lower connection assembly according to the present disclosure.

For run in, the upper connection assembly 110 in FIG. 6A can include a connection mechanism 119 to connect to the lower connection assembly (130; FIG. 7). The connection mechanism 119 can use keys, dogs, collet members, locks, latches, or any other feature to connect, couple, lock, latch, etc. with a comparable feature, such as a profile or the like, on the lower connection assembly (130; FIG. 7). The connection mechanism 119 allows the upper connection assembly 110 to mechanically connect with the lower connection assembly (130; FIG. 7) so the drill pipe 40 can run the lower connection assembly (130; FIG. 7) downhole. Such a connection mechanism 119 can be operated hydraulically using tubing pressure pumped down the drill pipe 40, or the connection mechanism 119 may be operated mechanically with tubing manipulation. Other forms of operation are also available.

Additionally, the upper connection assembly 110 in FIG. 6A also includes a wireless electronic controller 80, which can be disposed near the actuator assembly 150 as shown or could be positioned elsewhere on the upper connection assembly 110. One or more cables (not shown) connect from the wireless electronic controller 80 to the actuator assembly 150 and the upper connectors 160. These cables may be run internally. In one further configuration, the connection mechanism 119 can be electrically actuated using the wireless electronic controller 80.

By contrast, the upper connection assembly 110 in FIG. 6B may not include the wireless electronic controller. Instead, one or more control lines 38 run along the upper completion string 30 and connect with the actuator assembly 150 and the one or more upper connectors 160.

As shown in FIG. 6B, the upper completion string 30 can include a production packer 35, which can set and stabilize the upper completion string 30. Additionally, the upper connection assembly 110 of FIG. 6B includes an alignment shoe 114, a swivel 116, and a tubing contraction joint 118. The alignment shoe 114 can be designed to absorb unacceptably large shocks applied to the connector housing 111, for example, during run-in and tagging with the lower connection assembly (130; FIG. 7).

The alignment shoe 114 can include multiple rod pistons received in bores formed in the connection assembly 110. The bores can be filled with hydraulic fluid so that, as the rod pistons displace in the bores, the hydraulic fluid is forced to flow through a flow control valve that allows a predetermined flow rate. This dampens the displacement of the rod pistons.

The swivel 116 can allow for rotation of the connector housing 111 relative to the remainder of the upper connection assembly 110 to provide for rotational alignment of the upper connectors 160 with the lower connectors (180) of the lower connection assembly (130; FIG. 7).

The tubing contraction joint 118 can be designed to provide for controlled landing of a tubing hanger (not shown) after landing of the upper connection assembly 110 at a fixed point on top of the lower connection assembly (130; FIG. 7). The tubing contraction joint 118 can allow tubing of the upper completion string 30 to contract longitudinally, in order to land the tubing hanger in a wellhead, for example.

FIG. 7 shows a side view of an upper portion of the lower connection assembly 130. The lower connection assembly 130 includes a connector housing 131 and a polished bore receptacle 134, which are configured to receive and seal with the stinger 112 of the upper connection assembly 110 inserted therein. One or more lower connectors 180 are disposed on the connector housing 131 and are configured to connect with the upper connectors (160) of the upper connection assembly (110; FIG. 6A-6B). Below the connector housing 131 and polished bore receptacle 134, the lower connection assembly 130 includes the packers (52), electronic sensors (54), interval control valves (56), and the like. One or more control lines 58 or cables run from the lower connectors 180 along the lower connection assembly 130 to connect to these other components (e.g., 54, 56, etc.).

Figure 8A:
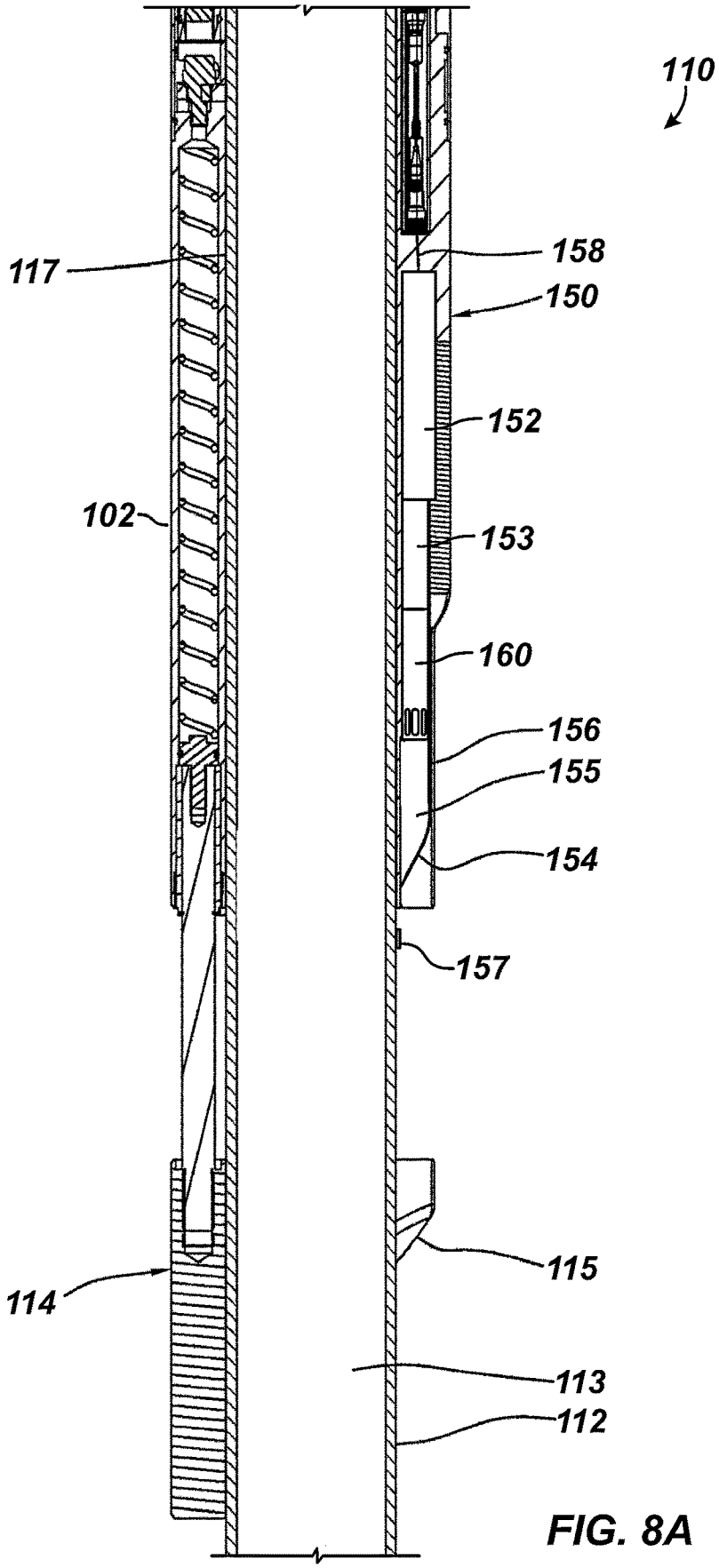
FIG. 8A illustrates a cross-section of a portion of the upper connection assembly in more detail.
Figure 8B:
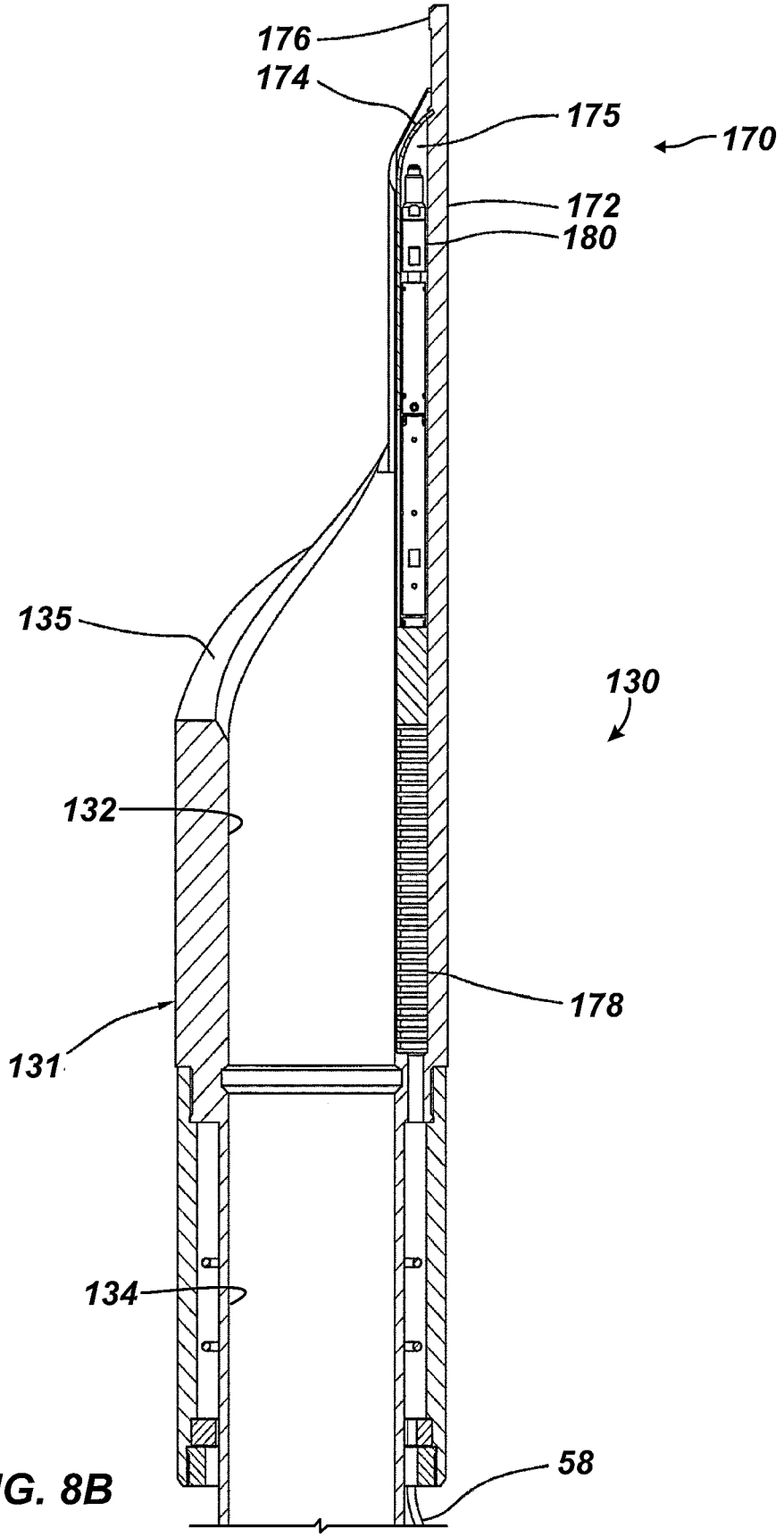
FIG. 8B illustrates a cross-section of a portion of the lower connection assembly in more detail.
Figure 9:
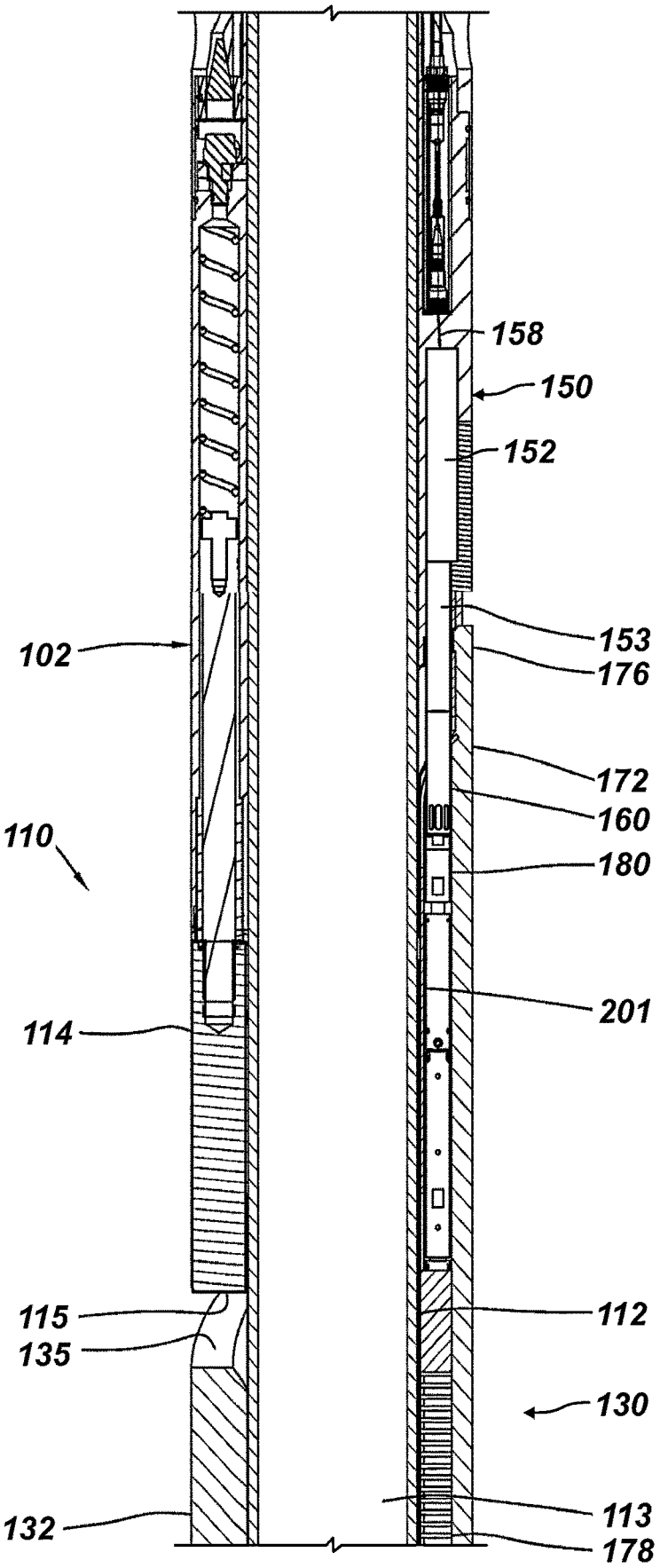
FIG. 9 illustrates a representative cross-sectional view of the upper and lower connection assemblies at full engagement.

Referring now to FIGS. 8A-8B, a cross-sectional view of the connector housing 111 of the upper connection assembly 110 is representatively illustrated in FIG. 8A, and a cross-sectional view of the connector housing 131 is representatively illustrated in FIG. 8B. FIG. 9 illustrates a cross-sectional view of the upper and lower connection assemblies 110, 130 operatively engaged.

In FIG. 8A, it may be seen that an upper end of the connector housing 111 of the upper connection assembly 110 is connected to a tubular mandrel 117 extending to the swivel (116; FIG. 6B). The connector housing 111 contains one or more internal upper connectors 160, which extend downward and are placed circumferentially about the connector housing 111. As noted, the one or more upper connectors 160 can be optical, electrical, and/or hydraulic connectors. As an optical connector, the upper connector 160 can be used for transmitting optical signals between separate sections of optical fiber or line. As an electrical connector, the upper connector 160 can be used for transmitting power and/or electric signals between separate sections of cable or line. As a hydraulic connector, the upper connector 160 can be used for transmitting hydraulic power between separate sections of cable or line.

One or more control lines 158 are operatively connected to the respective one or more connectors 160. The one or more connectors 160 can be shielded from the well environment by a protective barrier 154 slidably arranged relative to the connector housing 111 so that an enclosed chamber 155 is formed between the protective barrier 154 and the connector housing 111.

The barrier 154 can be displaced so that the one or more connectors 160 are exposed in response to engagement between the upper and lower connection assemblies 110, 130. In this manner, the one or more connectors 160 are enclosed and protected in the chamber 155 by the barrier 154, until it is desired to operatively connect the connectors 160 with corresponding connectors 180 in the lower connection assembly 130. When the upper and lower connection assemblies 110, 130 are engaged downhole, this physical contact is used to displace the barrier 154, so that the one or more upper and lower connectors 160, 180 can be operatively connected.

The alignment shoe 114 includes an alignment profile 115 formed at its lower end. The alignment profile 115 is used to rotationally align the upper and lower connection assemblies 110, 130 when they are engaged downhole.

The alignment profile 115 can be inclined and can have a shape of the type known to those skilled in the art as a "mule shoe." However, other shapes and types of alignment devices may be used in keeping with the principles of this disclosure.

When the alignment profile 115 contacts a complementarily shaped alignment profile 135 of the lower connection assembly 130 (see FIGS. 8B & 9), further axial compression of the upper and lower connection assemblies 110, 130 will maintain rotational and axial alignment of the connectors 160, 180. The engagement between the alignment profiles 115, 135 and the axial compressive force applied to them resists relative rotation between the upper and lower connector housings 111, 131 away from alignment.

Figure 10A:
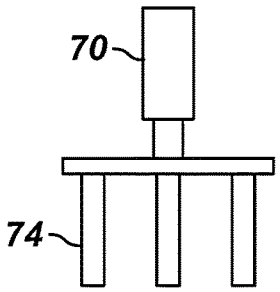
FIGS. 10A-10B illustrate schematic arrangements for actuators and connectors.
Figure 10B:
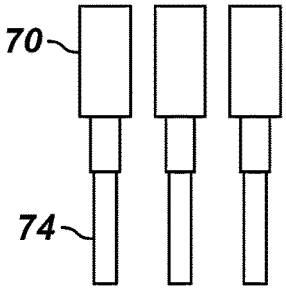

In FIG. 8A, an actuator assembly 150 is associated with the one or more upper connectors 160. If multiple connectors 160 are used, one actuator 152 of the actuator assembly 150 can move the multiple connectors 160 together, or each connector 160 can have its own actuator 152. (For illustrative purposes, FIG. 10A shows an example of one actuator 70 used to move multiple connectors 74 together, and FIG. 10B shows an example of each connector 74 having its own actuator 70.)

In the present example, the actuator 152 can be an electric motor, a linear actuator, a hydraulic piston, or the like housed on the connector housing 111 and connected by a piston, an arm, a spindle, a shaft, a linkage, or other connecting member 153 to the upper connector 160. One or more lines of the control lines 158 connect to the upper connectors 160 to conduct power, signals, hydraulics, etc. between the surface and downhole components. One or more lines of the control lines 158 connect to the actuator assembly 150 to conduct power, signals, hydraulics, etc. to actuate and control the actuator 152 of the actuator assembly 150.

The upper connector 160 is movable on the connection assembly 110 between a retracted condition and an extended condition. The upper connector 160 in the extended condition is configured to mate with a lower connector 180 and is configured to communicate the control lines with one another. The actuator 152 is configured to move the upper connector 160 at least from the retracted condition to the extended condition so it can mate with the lower connector 180.

Figure 11A:
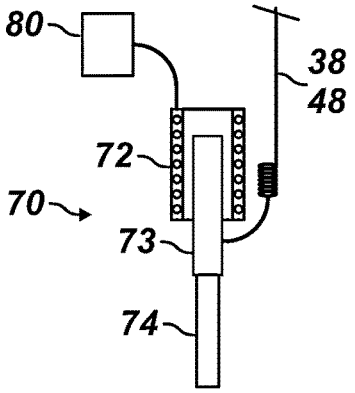
FIGS. 11A-11C illustrate different schematic arrangements of actuators.
Figure 11B:
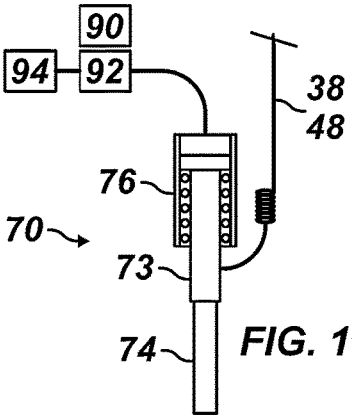
Figure 11C:
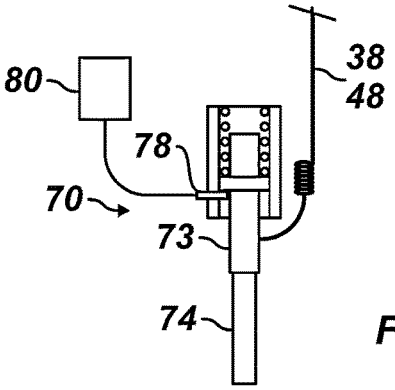

As previously noted, different types of actuators 152 can be used in the actuator assembly 150. (For illustrative purposes, FIGS. 11A-11C show example actuator arrangements. In the example of FIG. 11A, the actuator 70 can be an electric motor 72 that produces rotation or linear motion when powered by the wireless electronic controller 80. The electric motor 72 can move the connecting member or piston 73 as an arm that retracts/extends the upper connector 74. In another example of FIG. 11B, the actuator 70 can be a piston chamber 76 in which the connecting member 73 as a piston can be hydraulically moved to retract/extend the upper connector 74. An electric motor 90 can operate a hydraulic pump 92 to draw hydraulic fluid from a hydraulic source 94 to the piston chamber 76 to move the connecting member 73 and connector 74. A spring can bias the connecting member 73 to retract the connector 74 to a retracted condition. In yet another example of FIG. 11C, the actuator 70 can be a lock, latch, or trigger mechanism 78 holding the connecting member 73 as a biased arm in a retracted state. Release of the biased arm of the connecting member 73 by disengaging the lock, latch, or trigger mechanism 78 of the actuator 70 using the wireless electronic controller 80 can allow a spring or other bias to extend the upper connector 74. These and other actuators 70 can be used.)

Referring now to FIG. 8B, the lower connector housing 131 defines an opening 132 into which the stinger 112 of the upper connection assembly 110 can insert. The lower connector housing 131 also defines the complementary alignment profile 135 to engage and align with the alignment profile 115 of the upper connector housing 111. The polished bore receptacle 134 extends from the lower connector housing to seal with the stinger 112 of the upper connection assembly 110 inserted therein. For run in, the opening 132 in the lower connector housing 131 can define a profile 139 or other feature to engage a connection mechanism (119)—i.e., keys, dogs, collet members, locks, latches, or any other feature used on the running string's connector assembly.

The lower connectors 180 are arranged in the connector housing 131 so that they will be appropriately aligned with the upper connectors 160 in the upper connector housing 111 when the upper and lower connection assemblies 110, 130 are operatively engaged. The lower connectors 180 can be axially upwardly biased by compression springs 178 in the lower connector housing 131. A biasing force exerted by the springs 178 maintains the connectors 160, 180 in operative engagement, as described more fully below.

The lower connectors 180 are housed in an axially upwardly extending prong 172, which is slidingly received in a complementary axially extending slot formed in the upper connector housing (111) when the connector housings 111, 131 are rotationally aligned. Extending further axially outward from the prong 172 is an engagement device 176.

Control lines 158 are operatively connected to the respective lower connectors 180. The lower connectors 180 are shielded from the well environment by a protective barrier 174 slidably arranged relative to the connector housing 131 so that an enclosed chamber 175 is formed between the protective barrier and the connector housing 131.

The barrier 174 can be displaced so that the lower connectors 180 are exposed in response to engagement between the upper and lower connection assemblies 110, 130. In this manner, the lower connectors 180 are enclosed and protected in the chamber 175 by the barrier 174, until it is desired to operatively connect the lower connectors 180 with corresponding upper connectors (160) in the upper connection assembly (110) (see FIG. 9). When the upper and lower connection assemblies 110, 130 are engaged downhole, this physical contact is used to displace the barrier 174 so the connectors 160, 180 can be operatively connected.

FIG. 9 illustrates a cross-sectional view of the upper and lower connection assemblies 110, 130 operatively engaged. The connectors 160, 180 are operatively connected so that electric power, communication signals, and/or hydraulics can be communicated between the connectors 160, 180 of the control lines 38, 58. The barriers 154, 174 are displaced along respective slots or tracks formed in the upper and lower connector housings 111, 131.

The barriers 154, 174 slide in the respective tracks after they have been engaged by the respective engagement devices 157, 176 and there is relative displacement between the upper and lower connection assemblies 110, 130. The barriers 154, 174 can displace in either axial direction in the tracks and, thus, the barriers 154, 174 can be re-closed (after having been opened downhole) when the upper and lower connection assemblies 110, 130 are disengaged from each other downhole.

As depicted in FIG. 9, the barriers 154, 174 are displaced from their closed positions to their opened positions, and the chambers 155, 175 are open so that the connectors 160, 180 are exposed to each other. The connectors 160, 180 are operatively engaged with each other after: (I) the barriers 154, 174 are displaced to their opened positions, (ii) the alignment profiles 115, 135 are fully engaged, and the actuator 152 has been activated to move the upper connectors 160.

The springs 178 may be compressed in the lower connection assembly 130. This additional compression begins after: (i) the connection assemblies 110, 130 are fully engaged with each other (e.g., when the alignment profiles 115, 135 fully contact each other) and (ii) the connectors 160, 180 are operatively connected. The compressive biasing force exerted by the springs 178 can help to maintain the operative engagement of the connectors 160, 180.

The protective barriers 154, 174 can be single flexible sheets, multiple connected-together components, and the other shapes.

The tracks in the respective upper and lower connection assemblies 110, 130 can be axially elongated slots or grooves formed in the upper and lower connector housings 111, 131. In other examples, the tracks could comprise structures (such as rails, guides, or shoulders) that engage cooperative recesses or structures on the barriers 154, 174.

Other configurations for the engagement between the engagement devices 157, 176 and the respective barriers 154, 174 can be used. In some examples, projections or other structures on the barriers 154, 174 could engage recesses or structures of the engagement devices 157, 176.

The chambers 155, 175 may initially be filled with a clean, viscous substance (such as silicone grease) when the lower connection assembly 130 is installed in the well, and then the upper connection assembly 110 is run into the well to connect with the lower connection assembly 130. The substance can help to exclude debris from the chambers 155, 175 and reduce the entry of well fluids into the chambers 155, 175. The chambers 155, 175 and the substance therein are then exposed to the downhole environment just before the connectors 160, 180 are operatively connected.

The foregoing description of preferred and other embodiments is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A method of completing a well, the method comprising:

installing a lower completion in the well by running the lower completion using a running string, the lower completion having a lower connection assembly, the running string having a running connection assembly connected to the lower completion, the lower connection assembly comprising at least one lower connector, at least one lower control line, and at least one downhole component, the at least one lower connector connected to the at least one lower control line, the at least one downhole component connected to the at least one lower control line, the running connection assembly having an electronic controller connected to at least one running connector, the at least one running connector connected to the at least one lower connector;

remotely communicating the electronic controller with the at least one downhole component via the at least one running connector and the at least one lower connector connecting the at least one running control line with the at least one lower control line;

disconnecting the at least one running connector from the at least one lower connector by remotely actuating the at least one running connector with the electronic controller and moving the at least one running connector to unmate from the at least one lower connector;

disconnecting the running connection assembly from the lower connection assembly after the at least one running connector is unmated from the at least one lower connector;

removing the running string from the well;

installing an upper completion in the well by running the upper completion in the well, the upper completion having at least one upper control line and an upper connection assembly, the upper connection assembly comprising at least one upper connector connected to the at least one upper control line;

connecting the upper connection assembly to the lower connection assembly; and connecting the at least one upper connector to the at least one lower connector after the upper connection assembly is connected to the lower connection assembly by actuating the at least one upper connector and moving the at least one upper connector to mate with the at least one lower connector.

2. The method of claim 1, wherein remotely actuating the at least one running connector with the electronic controller and moving the at least one running connector to unmate from the at least one lower connector comprises:

wirelessly telemetering a signal to the electronic controller; and actuating, with the electronic controller in response to the signal, at least one actuator of the running connection assembly to move the at least one running connector from a mated condition to an unmated condition with the at least one lower connector.

3. The method of claim 2, wherein actuating the at least one actuator with the electronic controller comprises one of:

the step of powering an electric motor of the at least one actuator with an electric power source of the electronic controller; and the steps of powering a hydraulic pump with the electric power source of the electronic controller, pumping hydraulics from a hydraulic source with the hydraulic pump, and moving a hydraulic piston of the at least one actuator with the hydraulics pumped with the hydraulic pump.

4. The method of claim 1, wherein remotely communicating the electronic controller with the at least one downhole component comprises:

interrogating the at least one downhole component in a communication from the electronic controller; and obtaining a result at the electronic controller in response to the communication.

5. The method of claim 4, further comprising wirelessly telemetering the result from a telemetry unit of the electronic controller to surface.

6. The method of claim 4, wherein interrogating the at least one downhole component in the communication from the electronic controller comprises interrogating a sensor connected to the at least one lower control line; and wherein obtaining the result comprises obtaining a reading from the sensor.

7. The method of claim 4, wherein interrogating the at least one downhole component in the communication from the electronic controller comprises operating a control valve connected to the at least one lower control line in a test operation; and wherein obtaining the result comprises obtaining the result from the test operation.

8. The method of claim 1, wherein disconnecting the running connection assembly from the lower connection assembly comprises disengaging a connection mechanism of the running connection assembly from a profile of the lower connection assembly.

9. The method of claim 1, wherein actuating the at least one upper connector and moving the at least one upper connector to mate with the at least one lower connector comprises:

telemetering a signal to at least one actuator of the upper connection assembly; and actuating the at least one actuator to move the at least one upper connector from an unmated condition to a mated condition with the at least one lower connector.

10. The method of claim 9, wherein telemetering the signal to the at least one actuator comprises sending the signal via the at least upper control line.

11. The method of claim 1, wherein actuating the at least one upper connector and moving the at least one upper connector to mate with the at least one lower connector comprises mechanically triggering a trigger mechanism biasing the at least one upper connector to mate with the at least one lower connector.

12. The method of claim 1, wherein connecting the upper connection assembly to the lower connection assembly comprises:

axially engaging the upper connection assembly on the lower connection assembly;

radially engaging an upper alignment profile of the upper connection assembly to a lower alignment profile of the lower connection assembly; and aligning the at least one upper connector with the at least one lower connector using the upper alignment profile and the lower alignment profile.

13. The method of claim 1, wherein connecting the upper connection assembly to the lower connection assembly comprises sealing a stinger of the upper connection assembly in a polished bore receptacle of the lower connection assembly.

14. A method of completing a well, the method comprising:

installing a lower completion in the well using a running connection assembly of a running string connected to a lower connection assembly of the lower completion;

remotely communicating an electronic controller on the running string with at least one downhole component of the lower completion via at least one running connector of the running connection assembly in a mated condition with at least one lower connector of the lower connection assembly; and removing the running string from the well by:

wirelessly telemetering a signal to the electronic controller:

actuating, with the electronic controller in response to the signal, at least one actuator on the running connection assembly to move the at least one running connector from the mated condition to an unmated condition with the at least one lower connector; and disconnecting the running connection assembly from the lower connection assembly.

15. The method of claim 14, further comprising installing an upper completion in the well by:

running the upper completion in the well;

connecting an upper connection assembly of the upper completion to the lower connection assembly of the lower completion; and actuating at least one upper connector of the upper connection assembly to mate with the at least one lower connector.

16. The method of claim 14, wherein actuating the at least one actuator with the electronic controller comprises one of:

the step of powering an electric motor of the at least one actuator with an electric power source of the electronic controller; and the steps of powering a hydraulic pump with the electric power source of the electronic controller, pumping hydraulics from a hydraulic source with the hydraulic pump, and moving a hydraulic piston of the at least one actuator with the hydraulics pumped with the hydraulic pump.

17. The method of claim 14, wherein remotely communicating the electronic controller with the at least one downhole component comprises:

interrogating the at least one downhole component in a communication from the electronic controller;

obtaining a result at the electronic controller in response to the communication; and wirelessly telemetering the result from a telemetry unit of the electronic controller to surface.

18. The method of claim 17, wherein at least one of:

interrogating the at least one downhole component in the communication from the electronic controller comprises interrogating a sensor on the lower completion, and obtaining the result comprises obtaining a reading from the sensor; and interrogating the at least one downhole component in the communication from the electronic controller comprises operating a control valve of the lower completion in a test operation; and wherein obtaining the result comprises obtaining the result from the test operation.

19. The method of claim 14, wherein disconnecting the running connection assembly from the lower connection assembly comprises disengaging a connection mechanism of the running connection assembly from a profile of the lower connection assembly.

20. A method of completing a well, the method comprising:

installing a lower completion in the well by running the lower completion using a running string, the lower completion having a lower connection assembly, the running string having a running connection assembly connected to the lower completion, the lower connection assembly comprising at least one lower connector, at least one lower control line, and at least one downhole component, the at least one lower connector connected to the at least one lower control line, the at least one downhole component connected to the at least one lower control line, the running connection assembly having an electronic controller connected to at least one running connector, the at least one running connector connected to the at least one lower connector;

remotely communicating the electronic controller with the at least one downhole component via the at least one running connector and the at least one lower connector connecting the at least one running control line with the at least one lower control line;

removing the running string from the well by:

remotely actuating the at least one running connector with the electronic controller to unmate from the at least one lower connector; and disconnecting the running connection assembly from the lower connection assembly; and installing an upper completion in the well by:

running the upper completion in the well, the upper completion having at least one upper control line and an upper connection assembly, the upper connection assembly comprising at least one upper connector connected to the at least one upper control line;

connecting the upper connection assembly to the lower connection assembly;

telemetering a signal to at least one actuator of the upper connection assembly; and actuating the at least one actuator to move the at least one upper connector from an unmated condition to a mated condition with the at least one lower connector.

21. A method of completing a well, the method comprising:

installing a lower completion in the well by running the lower completion using a running string, the lower completion having a lower connection assembly, the running string having a running connection assembly connected to the lower completion, the lower connection assembly comprising at least one lower connector, at least one lower control line, and at least one downhole component, the at least one lower connector connected to the at least one lower control line, the at least one downhole component connected to the at least one lower control line, the running connection assembly having an electronic controller connected to at least one running connector, the at least one running connector connected to the at least one lower connector;

remotely communicating the electronic controller with the at least one downhole component via the at least one running connector and the at least one lower connector connecting the at least one running control line with the at least one lower control line;

removing the running string from the well by:

remotely actuating the at least one running connector with the electronic controller to unmate from the at least one lower connector; and disconnecting the running connection assembly from the lower connection assembly; and installing an upper completion in the well by:

running the upper completion in the well, the upper completion having at least one upper control line and an upper connection assembly, the upper connection assembly comprising at least one upper connector connected to the at least one upper control line;

connecting the upper connection assembly to the lower connection assembly; and actuating the at least one upper connector to mate with the at least one lower connector by mechanically triggering a trigger mechanism biasing the at least one upper connector to mate with the at least one lower connector.

* * * * *